US010506332B2

(12) United States Patent
Shang et al.

(10) Patent No.: US 10,506,332 B2
(45) Date of Patent: Dec. 10, 2019

(54) LOUDSPEAKER MODULE

(71) Applicant: Goertek Inc., Shandong (CN)

(72) Inventors: Yue Shang, Shandong (CN); Shuzhi Zhou, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 15/759,542

(22) PCT Filed: Nov. 16, 2015

(86) PCT No.: PCT/CN2015/094686
§ 371 (c)(1),
(2) Date: Mar. 13, 2018

(87) PCT Pub. No.: WO2017/045262
PCT Pub. Date: Mar. 23, 2017

(65) Prior Publication Data

US 2019/0158953 A1 May 23, 2019

(30) Foreign Application Priority Data

Sep. 15, 2015 (CN) ..... 2015 2 0713869 U

(51) Int. Cl.
*H04R 1/28* (2006.01)
*H04R 1/02* (2006.01)

(52) U.S. Cl.
CPC ..... *H04R 1/2857* (2013.01); *H04R 1/025* (2013.01); *H04R 1/2888* (2013.01); *H04R 2201/029* (2013.01); *H04R 2499/11* (2013.01)

(58) Field of Classification Search
CPC .. H04R 1/2857; H04R 1/025; H04R 2499/11; H04R 1/2888; H04R 2201/029
See application file for complete search history.

(56) References Cited

U.S. PATENT DOCUMENTS 3,835,256 A * 9/1974 Wieder ..... H04R 1/021 181/154
2003/0228027 A1* 12/2003 Czerwinski ..... H04R 1/26 381/342

(Continued)

FOREIGN PATENT DOCUMENTS

CN 1342384 A 3/2002
CN 1551678 A 12/2004

(Continued)

OTHER PUBLICATIONS

International Searching Authority, International Search Report (ISR) and Written Opinion for International Application No. PCT/CN2015/094686, dated Jun. 3, 2016, 8 pages, State Intellectual Property Office of the P.R.C., China.

*Primary Examiner* — Andrew L Sniezek
(74) *Attorney, Agent, or Firm* — Alston & Bird LLP

(57) ABSTRACT

A loudspeaker module, comprising a housing and a loudspeaker unit accommodated inside the housing, wherein the loudspeaker unit comprises a vibration diaphragm, a side wall of the housing is provided with a side sound hole of the loudspeaker module, a space formed by the vibration diaphragm, the housing and the side sound hole is a sound channel of a front acoustic cavity, the sound channel comprises a root portion close to the vibration diaphragm, an opening portion close to the side sound hole and side walls connecting the root portion and the opening portion and arranged oppositely, the side walls comprise a straight side wall and a bent side wall, and the width of the root portion of the sound channel is greater than the width of the opening portion.

8 Claims, 1 Drawing Sheet

(56) References Cited

U.S. PATENT DOCUMENTS

| | | | |
|---|---|---|---|
| 2005/0039975 | A1 | 2/2005 | Sadaie et al. |
| 2005/0259841 | A1 | 11/2005 | Caron et al. |

FOREIGN PATENT DOCUMENTS

| | | | |
|---|---|---|---|
| CN | 202160257 | U | 3/2012 |
| CN | 204119507 | U | 1/2015 |
| CN | 204291356 | U | 4/2015 |

* cited by examiner

LOUDSPEAKER MODULE

CROSS-REFERENCE TO RELATED APPLICATIONS

This application is a National Stage of International Application No. PCT/CN2015/094686, filed on Nov. 16, 2015, which claims priority to Chinese Patent Application No. 201520713869.0, filed on Sep. 15, 2015, both of which are hereby incorporated by reference in their entireties.

BACKGROUND

Technical Field

The present invention relates to the field of electroacoustics, and in particular, to a loudspeaker module.

Description of Related Art

As a device for converting electrical energy into sound energy, a loudspeaker is widely used in terminal electronic devices such as mobile phones, computers, MP3 and PAD. In the prior art, when the loudspeaker is assembled with a terminal device, it usually needs to place a loudspeaker unit into an outer housing which accommodates the single body, and then the loudspeaker is assembled into the terminal device, such as a mobile phone, in the form of a module.

With the rapid development of science and technology as well as electronic industry, people present higher demands on the performance of loudspeaker products. In the current market environment, it not only requires that the loudspeaker module makes loud sound and has better sound quality, but also requires that harmonic distortion thereof is reduced, which sets a stricter standard for a harmonic distortion test of the loudspeaker products and is a great challenge for listening and the test of the loudspeaker products under a high voltage. However, for an existing loudspeaker module structure, a sound channel thereof takes a wide variety of designs. The design of part of sound channels can realize that a high-order harmonic distortion test is qualified under a rated voltage, but hardly realize that related tests are qualified under a high voltage. Therefore, for this problem, there is still an urgent need of making further improvement and exploration on the design of the sound channel.

BRIEF SUMMARY

The technical problem to be solved by the present invention is to provide a loudspeaker module. By designing a sound channel structure of the loudspeaker module, the high-order harmonic distortion of the loudspeaker module is reduced and thus the sound quality of loudspeaker module is improved.

In order to achieve the above purpose, the present invention adopts the following technical solution. A loudspeaker module comprises a housing and a loudspeaker unit accommodated in the housing, wherein a side sound hole of the loudspeaker module is arranged on a side wall of the housing; a space formed among the loudspeaker unit, the housing, and the side sound hole is a sound channel of a front acoustic cavity; the sound channel comprises a root part close to the loudspeaker unit, an opening part close to the side sound hole, and side walls of the sound channel connected to the root part and the opening part; the side walls of the sound channel comprises a flat and straight side wall of the sound channel and a bent side wall of the sound channel, which are oppositely arranged; and the width of the root part of the sound channel is greater than the width of the opening part.

As an improvement, the housing comprises an upper housing and a lower housing cooperating with the upper housing; and the side sound hole is arranged on a side wall of the upper housing.

As an improvement, the side wall of the sound channel is a side wall arranged on the upper housing.

As an improvement, the flat and straight side wall of the sound channel is perpendicular to the root part of the sound channel and extends towards a direction of the opening part flatly and straightly.

As an improvement, the bent side wall of the sound channel comprises a flat and straight part perpendicular to the root part, and a bent part; and the bent part extends towards the direction of the opening part and is smoothly coupled to the opening part.

As an improvement, the bent part gradually approximates the flat and straight side wall of the sound channel; and a part, close to the opening part, of the sound channel contracts inwards.

As an improvement, the length of the flat and straight part is ½ of the length of the bent side wall of the sound channel in a direction perpendicular to the root part of the sound channel.

As an improvement, the side sound hole is arranged along a direction parallel to the loudspeaker unit.

As an improvement, the loudspeaker module is further provided with a PET sheet for sealing separately and in a sealed manner the front acoustic cavity from a rear acoustic cavity.

When the loudspeaker module of the present invention is compared with the prior art, the sound channel thereof comprises a root part close to the loudspeaker unit, an opening part close to the side sound hole, and a side wall connected to the root part and the opening part. The side wall comprises a flat and straight side wall and a bent side wall, which are oppositely arranged. Moreover, the width of the root part of the sound channel is greater than the width of the opening part. With such a structural design, sound waves can propagate more smoothly in the sound channel, and reflection of and interference to the sound waves caused by the side wall of the sound channel are reduced. Therefore, the high-order harmonic distortion is minimized effectively, and thus the sound quality of the loudspeaker can be effectively improved. Hence, the sound is more clear and pleasant, and brings more wonderful acoustic enjoyment to the audience. The current increasing demands on the performance of the loudspeaker products can also be met.

The reference signs represent the following components: 1: upper housing; 2: lower housing; 3: loudspeaker unit; 4: sound channel; 41: root part; 42: opening part; 43: flat and straight side wall; 44: bent side wall; 440: flat and straight part; 441: bent part; 5: PET sheet; and 6: side sound hole.

BRIEF DESCRIPTION OF THE VARIOUS EMBODIMENTS

The present invention is described in detail below in conjunction with the accompanying drawings.

Embodiment

Figure 1:
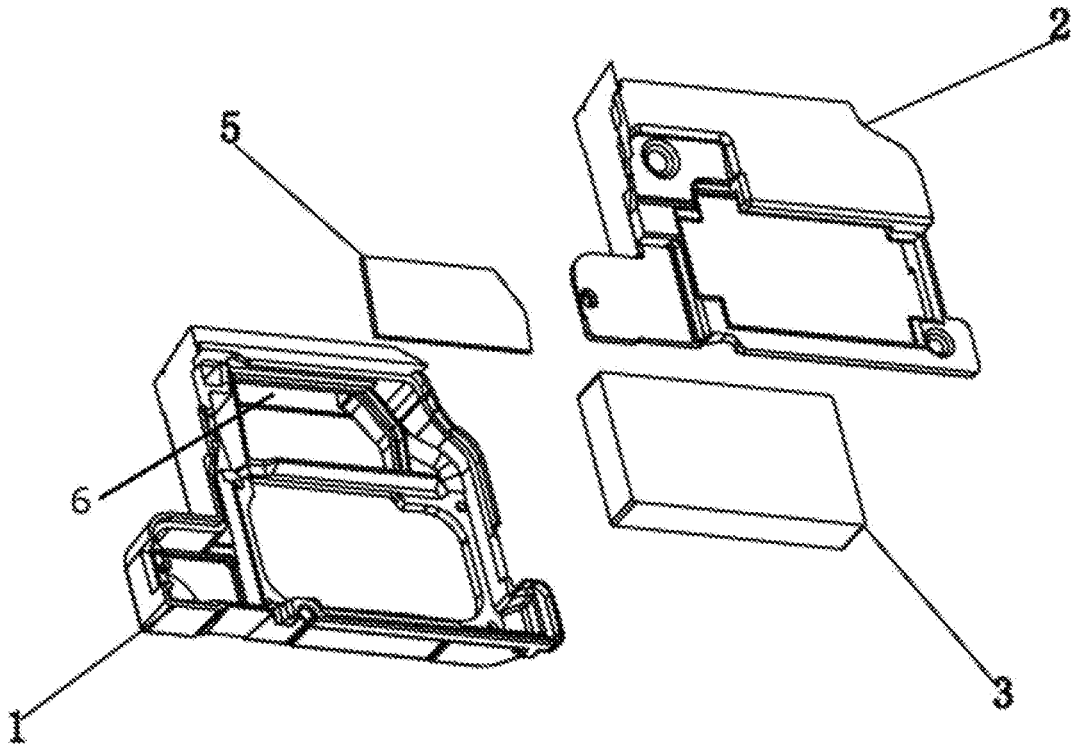
FIG. 1 is an exploded view of the loudspeaker module structure of the present invention.
Figure 2:
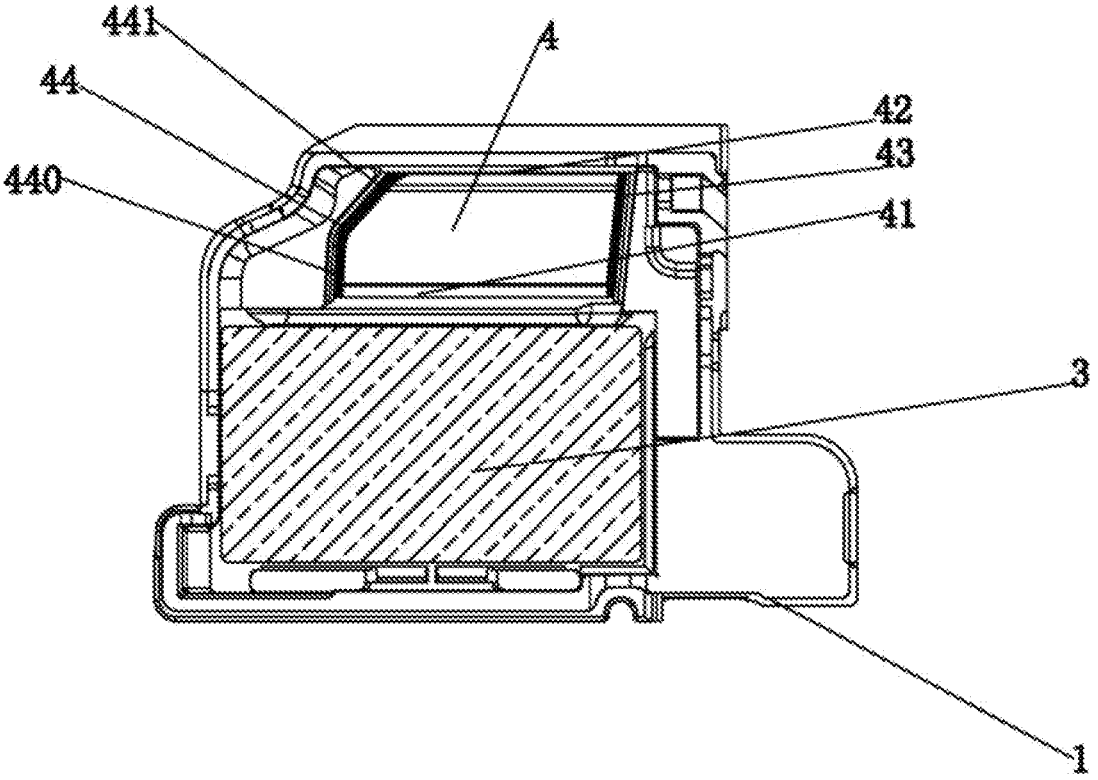
FIG. 2 is a sectional view of the loudspeaker module structure of the present invention.

With reference to FIGS. 1 and 2, the loudspeaker module of the present invention comprises a housing and a loudspeaker unit accommodated in the housing. In a specific implementation mode, the housing comprises an upper housing 1 and a lower housing 2, which cooperate with each other to form a chamber. The loudspeaker unit 3 is accommodated in the chamber. As a basic sound production unit, the loudspeaker unit 3 specifically comprises a magnetic circuit system, a vibration system and an auxiliary system. The vibration system comprises a vibration diaphragm (not shown) which can produce sound under the driving of a voice coil. The vibration diaphragm is vibrated under the driving of the voice coil to generate sound waves. A sound channel (i.e., a channel, through which the sound waves radiate outwards) is cooperatively arranged in an inner chamber of the loudspeaker. An outlet (i.e., a sound hole) of the sound waves is arranged on an outer housing. The present implementation mode shows a loudspeaker module which makes sound from a side. A side sound hole 6 is arranged on a side wall of a housing thereof, specifically on a side wall of the upper housing 1. A sound channel 4 of a front acoustic cavity is a channel from a position (loudspeaker unit 3, in particular the vibration diaphragm therein), where sound is produced, to the side sound hole 6, and is formed by the loudspeaker unit 3, the housing and the side sound hole 6 cooperatively.

With reference to FIG. 2, the sound channel 4 comprises a root part 41 close to the loudspeaker unit 3, an opening part 42 close to the side sound hole 6, and a side wall (the side wall herein is actually a side wall arranged on the upper housing 1) connected to the root part 41 and the opening part 42. In the loudspeaker module of the present invention, the side wall of the sound channel 4 thereof comprises a flat and straight side wall 43 and a bent side wall 44, which are oppositely arranged. The flat and straight side wall 43 is perpendicular to the root part 41 of the sound channel and extends towards a direction of the opening part 42 flatly and straightly, while the bent side wall 44 is of a bent structure, and specifically comprises a flat and straight part 440 and a bent part 441. The flat and straight part 440 is also perpendicular to the root part 41 of the sound channel while the bent part 441 extends towards the direction of the opening part 42 and is smoothly coupled to the opening part 42. In addition, the bent part 441 of the bent side wall 44 gradually approximates the flat and straight side wall 43 in an extending process, that is, a part, close to the opening part 42, of the sound channel 4 contracts inwards. In other words, the width of the root part 41 of the sound channel is greater than the width of the opening part 42.

By means of the above technical solution, the side wall of the sound channel of the loudspeaker module which makes sound from a side is designed to be of a structure with one flat and straight side and one bent side, and it is guaranteed that the root part is wider than the opening part. Thus, sound waves can propagate more smoothly in the sound channel, and reflection of and interference to the sound waves caused by the side wall of the sound channel are reduced. Therefore, high-order harmonic distortion is minimized effectively, and thus the sound quality of the loudspeaker can be effectively improved.

Preferably, the length of the flat and straight part 440 is ½ of the length of the bent side wall 44 in a direction perpendicular to the root part 41 of the sound channel. During specific implementation, the effects of the present technical solution can be achieved, so long as the side wall of the sound channel is flat and straight on one side and is bent on the other side, and the width of the root part 41 is greater than the width of the opening part 42. The FIG. 1/2 illustrated herein is only an optimized design of the solution. That is, if it is assumed that the length of the bent side wall 44 in the direction perpendicular to the root part 41 of the sound channel is L, the effects are optimal when the length of the flat and straight part 440 is ½L.

Preferably, the side sound hole 6 is arranged along a direction parallel to the loudspeaker unit 3. When the vibration diaphragm is vibrated under the driving of a voice coil, the sound waves can propagate to the side sound hole 6 through the sound channel more smoothly.

Preferably, a polyethylene terephthalate (PET) sheet 5 is further arranged in the chamber of the loudspeaker module for separating in a sealed manner the front acoustic cavity from a rear acoustic cavity of the module.

It should be noted that the present technical solution is mainly suitable for the loudspeaker module which produce sound from a side. In the module structure shown in the present implementation mode, an outer housing thereof comprises an upper housing and a lower housing. Actually, the present technical solution is not limited to the above module structure with a housing comprising two parts, and is also suitable for modules comprising three parts, namely, an upper housing, a middle module housing and a lower housing, without being affected thereby. Likewise, no matter in which part of the housing the side sound hole is arranged, the technical solution is not affected as soon as the design of the sound channel thereof meets the requirements of the present solution.

The above contents are merely implementation cases of the present invention and are not intended to limit the present invention. All the equivalent modifications or changes made by those of ordinary skill in the art according to the content of the present invention shall fall within the protection scope defined by the claims.

What is claimed is:

1. A loudspeaker module comprising:

a housing; and a loudspeaker unit accommodated in the housing, wherein:

a side sound hole of the loudspeaker module is arranged on a side wall of the housing, a space formed among the loudspeaker unit, the housing, and the side sound hole is a sound channel of a front acoustic cavity, the sound channel comprises a root part close to the loudspeaker unit, an opening part close to the side sound hole, and side walls of the sound channel connected to the root part and the opening part, the side walls of the sound channel comprise a flat and straight side wall of the sound channel and a bent side wall of the sound channel, which are oppositely arranged;

the width of the root part of the sound channel is greater than the width of the opening part; and the loudspeaker module further comprises a polyethylene terephthalate sheet for separating, in a sealed manner, the front acoustic cavity from a rear acoustic cavity in the housing, the polyethylene terephthalate sheet together with the loudspeaker unit divide an inner space of the housing into the front acoustic cavity and the rear acoustic cavity, the rear acoustic cavity and the front acoustic cavity being respectively located on two sides of the loudspeaker unit.

2. The loudspeaker module of claim 1, wherein the housing comprises an upper housing and a lower housing cooperating with the upper housing; and the side sound hole is arranged on a side wall of the upper housing.

3. The loudspeaker module of claim 2, wherein the side walls of the sound channel are arranged on the upper housing.

4. The loudspeaker module of claim 1, wherein the flat and straight side wall of the sound channel is perpendicular to the root part of the sound channel and extends towards a direction of the opening part flatly and straightly.

5. The loudspeaker module of claim 1, wherein:

the bent side wall of the sound channel comprises a flat and straight part perpendicular to the root part, and a bent part; and the bent part extends towards the direction of the opening part and is smoothly coupled to the opening part.

6. The loudspeaker module of claim 5, wherein:

the bent part gradually approximates the flat and straight side wall of the sound channel; and a part, close to the opening part, of the sound channel contracts inwards.

7. The loudspeaker module of claim 5, wherein the length of the flat and straight part is ½ of the length of the bent side wall of the sound channel in a direction perpendicular to the root part of the sound channel.

8. The loudspeaker module of claim 1, wherein the side sound hole is arranged along a direction parallel to the loudspeaker unit.

* * * * *